US009719746B1

(12) United States Patent
Lyman et al.

(10) Patent No.: US 9,719,746 B1
(45) Date of Patent: Aug. 1, 2017

(54) MACHINE GUN ASSEMBLY AND INTERLOCK ELEMENT FOR USE WITH A MACHINE GUN ASSEMBLY

(71) Applicant: General Dynamics—OTS, Inc., Charlotte, NC (US)

(72) Inventors: Michael J. Lyman, Fairfax, VT (US); Jason Knight, Georgia, VT (US); Jonathan Piazza, Georgia, VT (US); Peter C. Wolff, Williston, VT (US); David B. Stouffer, Williston, VT (US)

(73) Assignee: General Dynamics—OTS, Inc., St. Petersburg, FL (US)

( * ) Notice: Subject to any disclaimer, the term of this patent is extended or adjusted under 35 U.S.C. 154(b) by 1000 days.

(21) Appl. No.: 14/019,886

(22) Filed: Sep. 6, 2013

Related U.S. Application Data

(60) Provisional application No. 61/699,512, filed on Sep. 11, 2012.

(51) Int. Cl.

| | |
|---|---|
| ***F41C 27/00*** | (2006.01) |
| ***F41A 9/62*** | (2006.01) |
| ***F41A 29/00*** | (2006.01) |
| ***F41A 21/48*** | (2006.01) |

(52) U.S. Cl.
CPC ..... *F41A 21/482* (2013.01); *F41A 21/481* (2013.01)

(58) Field of Classification Search
CPC .... F41A 21/482; F41A 21/484; F41A 21/481; F41A 21/48; F41A 21/08; F41A 3/86; F41A 9/45
USPC ..... 42/75.02; 89/9–13.1
See application file for complete search history.

(56) References Cited

U.S. PATENT DOCUMENTS

| | | | | | |
|---|---|---|---|---|---|
| 1,994,489 | A * | 3/1935 | Simpson | F41A 21/482 | 42/1.07 |
| 2,061,313 | A * | 11/1936 | Moore | F41A 21/482 | 42/75.02 |
| 2,554,714 | A * | 5/1951 | McPherren | F41A 31/00 | 73/167 |
| 2,611,297 | A * | 9/1952 | Simpson | F41A 21/484 | 42/75.02 |
| 3,386,336 | A * | 6/1968 | Roy | F41A 3/72 | 42/75.02 |
| 3,630,118 | A * | 12/1971 | Stoner | F41A 3/26 | 89/13.05 |

(Continued)

*Primary Examiner* — Samir Abdosh
(74) *Attorney, Agent, or Firm* — LKGlobal | Lorenz & Kopf, LLP

(57) ABSTRACT

A machine gun assembly includes, but is not limited to, a receiver, a barrel extension, and an interlock element. The barrel extension is mounted to the receiver and moves between forward and retracted positions with respect to the receiver. The barrel extension is configured for quick-release engagement with a barrel. The interlock element is mounted to the receiver and moves between a blocking position and a clear position. The interlock element has a blocking portion positioned to obstruct movement of the barrel extension to the forward position while in the blocking position and the blocking portion is positioned to permit movement of the barrel extension to the forward position while in the clear position. The interlock element moves to the blocking position when the barrel disengages from the barrel extension and moves to the clear position when the barrel is correctly engaged with the barrel extension.

19 Claims, 8 Drawing Sheets

(56) References Cited

U.S. PATENT DOCUMENTS

| | | | | | |
|---|---|---|---|---|---|
| 3,645,165 | A * | 2/1972 | Wohlford | F41A 3/26 | 89/11 |
| 4,685,235 | A * | 8/1987 | Bunning | F41A 21/484 | 42/75.02 |
| 5,155,284 | A * | 10/1992 | Flashkes | F41C 33/08 | 42/75.02 |
| 8,490,312 | B2 * | 7/2013 | Barrett | F41A 3/26 | 42/75.02 |
| 8,640,372 | B2 * | 2/2014 | Hochstrate | F41A 5/18 | 42/111 |
| 8,782,943 | B2 * | 7/2014 | Jarboe | F41A 21/485 | 42/75.02 |
| 9,383,154 | B2 * | 7/2016 | Stone | F41A 21/481 | |
| 9,464,859 | B2 * | 10/2016 | Potter | F41A 3/30 | |
| 2003/0037666 | A1 * | 2/2003 | Bero | F41A 19/32 | 89/9 |
| 2012/0090150 | A1 * | 4/2012 | Vuksanovich | F41A 21/48 | 29/428 |
| 2012/0216439 | A1 * | 8/2012 | Barrett | F41A 3/26 | 42/75.02 |
| 2013/0047833 | A1 * | 2/2013 | Steimke | F41A 5/26 | 89/191.01 |
| 2014/0115938 | A1 * | 5/2014 | Jarboe | F41A 21/485 | 42/71.01 |
| 2016/0313081 | A1 * | 10/2016 | Stone | F41A 21/481 | |

* cited by examiner

MACHINE GUN ASSEMBLY AND INTERLOCK ELEMENT FOR USE WITH A MACHINE GUN ASSEMBLY

CLAIM OF PRIORITY

This application claims the benefit of U.S. Provisional Application No. 61/699,512 which was filed on Sep. 11, 2012, which is hereby incorporated herein by reference in its entirety.

TECHNICAL FIELD

The present invention generally relates to a weapon and more particularly relates to a machine gun assembly and an interlock element for use with a machine gun assembly.

BACKGROUND

Machine gun assemblies include a barrel for guiding and controlling the direction of a round after it has been expelled from its cartridge as the machine gun assembly is discharged. The barrel includes a chamber for receiving a cartridge prior to discharging the weapon and for housing the cartridge during, and subsequent to, the discharge of the weapon. The barrel further includes a bore which guides the round as it travels through the barrel. The barrel is attached to a barrel extension which, in turn, is mounted to a receiver of the machine gun assembly. The barrel extension includes a slot in which a bolt sub-assembly is mounted. The barrel extension is configured to move with respect to the receiver so it can reciprocate as the machine gun assembly is fired and then recoils, and the bolt sub-assembly is configured to move both together with the barrel extension as the barrel extension moves, and also to move with respect to the barrel extension to permit the loading of unexpended cartridges and the expulsion of expended cartridges. A trigger bar is mounted to the receiver and remains stationary with respect to the receiver. Accordingly, as the barrel extension and the bolt move with respect to the receiver, they also move with respect to the trigger bar.

When the barrel extension and the bolt are in their respective forward positions, the trigger bar comes to rest over a sear. The sear is part of the bolt sub-assembly and is configured to control the release of the firing pin (which is also part of the bolt sub-assembly). When the trigger bar depresses downwardly onto the sear, the sear releases the firing pin which, under the force of a spring, moves rapidly into engagement with the primer of the cartridge. This causes the propellant inside of the cartridge to combust and rapidly expand, thereby expelling the round into the bore, down the barrel, out of the machine gun assembly, and down range.

Modern machine gun assemblies include a barrel that can be quickly released from, and re-engaged with, the barrel extension. In some known examples, such quick release engagement is accomplished through the use of quick release threads. Quick release threads are threads which do not wrap completely around the circumference of the barrel or the barrel extension, but rather, only extend partially around the circumference. The use of quick release threads permit the barrel to be disengaged from, and re-engaged with, the barrel extension by rotating the barrel through only a portion of a rotation (e.g., by turning the barrel sixty or ninety degrees).

In some instances, it has been observed that operators who use the quick release mechanism to disassemble the barrel from the barrel extension may incorrectly re-assemble the machine gun assembly by forgetting to partially rotate the barrel, thereby failing to cause re-engagement between the quick release threads of the barrel and the quick release threads of the barrel extension. Because conventional machine gun assemblies have no means of preventing the weapon from being fired while the barrel is not properly engaged with the barrel extension, the failure to correctly engage the barrel with the barrel extension can lead to undesirable circumstances.

Accordingly, it is desirable to provide a machine gun assembly that is inhibited from being discharged while the barrel is not properly engaged with the barrel extension. In addition, it is desirable to provide an interlock element that can be used to render a machine gun assembly non-dischargeable when the barrel is not properly engaged with the barrel extension. Furthermore, other desirable features and characteristics of the present invention will become apparent from the subsequent detailed description and the appended claims, taken in conjunction with the accompanying drawings and the foregoing technical field and background.

BRIEF SUMMARY

A machine gun assembly and an interlock element for use with a machine gun assembly are disclosed herein.

In a first, non-limiting embodiment, the machine gun assembly includes, but is not limited to a receiver. The machine gun assembly further includes, but is not limited to, a barrel extension mounted to the receiver and configured to move between a forward position and a retracted position with respect to the receiver. The barrel extension is biased towards the forward position and is configured for quick-release engagement with a barrel. The machine gun assembly further includes, but is not limited to, an interlock element that is mounted to the receiver and that is configured to move between a blocking position and a clear position. The interlock element is biased towards the blocking position. The interlock element has a blocking portion that is positioned to obstruct movement of the barrel extension to the forward position when the interlock element is in the blocking position. The blocking portion is positioned to permit movement of the barrel extension to the forward position when the interlock element is in the clear position. The interlock element is configured to move to the blocking position when the barrel disengages from the barrel extension and the interlock element is configured to move to the clear position when the barrel engages the barrel extension.

In another non-limiting embodiment, the machine gun assembly includes, but is not limited to, a receiver. The machine gun assembly further includes, but is not limited to, a barrel extension that is mounted to the receiver and that is configured to move between a forward position and a retracted position with respect to the receiver. The barrel extension is biased towards the forward position and has a set of female quick release threads. The machine gun assembly further includes, but is not limited to, a bolt sub-assembly that is mounted to the barrel extension and that is configured to move together with the barrel extension. The bolt sub-assembly includes a firing pin that is configured to engage a cartridge and a sear that is configured to control the firing pin. The machine gun assembly further includes, but is not limited to, a barrel that is configured to be selectively engaged with, and disengaged from, the barrel extension. The barrel has a chamber, a bore, and a set of male quick release threads that are engaged with the female set of quick release threads when the barrel is engaged with the barrel extension. The machine gun assembly further includes, but is not limited to, a trigger bar that is positioned above and adjacent to the bolt and is configured to remain stationary with respect to the receiver. The trigger bar is disposed in a firing window with respect to the sear when the barrel extension is in the forward position. The trigger bar is disposed outside of the firing window when the barrel extension is out of the forward position. The machine gun assembly still further includes, but is not limited to, an interlock element that is mounted to the receiver and that is configured to move between a blocking position and a clear position. The interlock element is biased towards the blocking position. The interlock element has a blocking portion positioned to obstruct movement of the barrel extension to the forward position when the interlock element is in the blocking position. The interlock element also has allowances for the blocking portion to be positioned to permit movement of the barrel extension to the forward position when the interlock element is in the clear position. The interlock element is configured to move to the blocking position when the barrel disengages from the barrel extension. The interlock element is configured to move to the clear position when the male quick release threads are correctly engaged with the female quick release threads.

In another non-limiting embodiment, the interlock element may be used with the machine gun assemblies described above. The interlock element includes a supporting portion that is configured for attachment to the receiver. The supporting portion is configured to move between a blocking position and a clear position. The interlock element further includes, but is not limited to, a blocking portion. The blocking portion is associated with the supporting portion and is configured to obstruct movement of the barrel extension to the forward position when the interlock element is in the blocking position while the supporting portion is attached to the receiver. The blocking portion is configured to permit movement of the barrel extension to the forward position when the interlock element is in the clear position while the supporting portion is attached to the receiver.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

An improved machine gun assembly is disclosed herein. In a non-limiting example, the machine gun assembly of the present disclosure includes an interlock element that is configured to inhibit movement of the barrel extension to its forward position unless the barrel is correctly engaged with the barrel extension. As used herein, the term "forward position" when describing the position of the barrel extension refers to the forward limit of its forward travel with respect to the receiver. In order to remove the barrel from the barrel extension, the barrel extension must first be retracted or moved backwards from its forward position. This protocol inhibits unwanted disengagement of the barrel from the barrel extension while the weapon is being discharged. In a scenario where the barrel has not been properly engaged in the barrel extension, the barrel extension moves backwards from its forward position, the interlock element moves to a blocking position under the urging of a biasing element. While the interlock element is in the blocking position, it acts as an obstruction that inhibits the barrel extension from returning to its forward position. With the barrel extension held out of its forward position, the bolt sub-assembly (which travels with the barrel extension as the barrel extension moves back and forth) is held outside of the firing window (i.e., the position where the trigger bar is able to engage the sear). With the trigger bar held outside of the firing window, the machine gun assembly cannot be fired.

As the barrel is correctly engaged with the barrel extension, the barrel engages the interlock element and causes the interlock element to move to a clear position. When the interlock element moves to the clear position, the obstruction of the barrel extension is removed. The barrel extension, which is biased towards the forward position, will then automatically return to its forward position. As the barrel extension moves to the forward position, the bolt sub-assembly travels with it and moves into the firing window. With the bolt sub-assembly disposed in the firing window, the trigger bar is able to engage the sear and actuate a firing cycle of the machine gun assembly.

A greater understanding of the embodiments of machine gun assembly and of the interlock for use with a machine gun assembly may be obtained through a review of the illustrations accompanying this application together with a review of the detailed description that follows.

Figure 1:
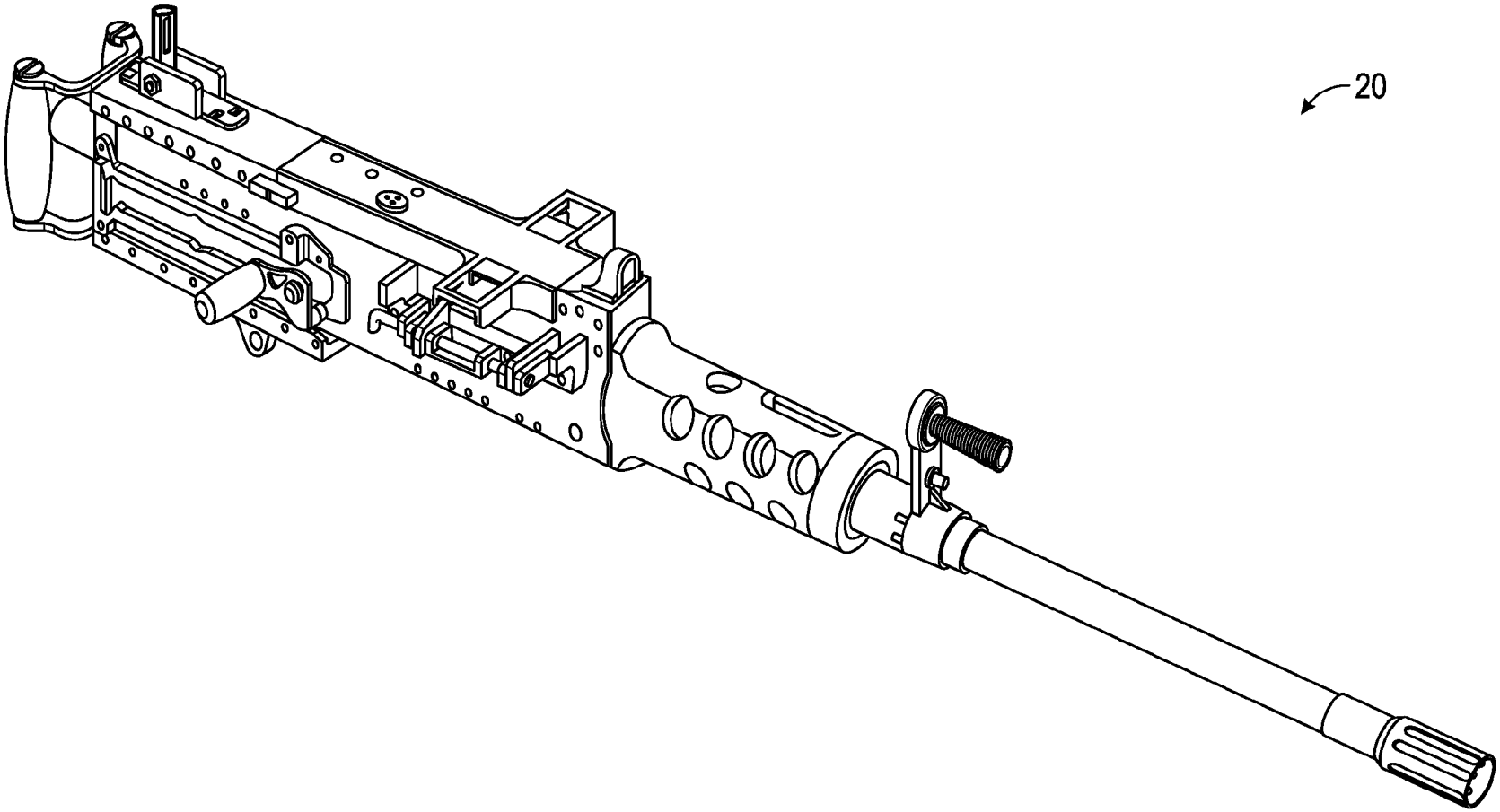
FIG. 1 is a perspective view of a non-limiting embodiment of a machine gun assembly made in accordance with the teachings of the present disclosure.

FIG. 1 is a perspective view of a non-limiting embodiment of a machine gun assembly 20, made in accordance with the teachings of the present disclosure.

Figure 2:
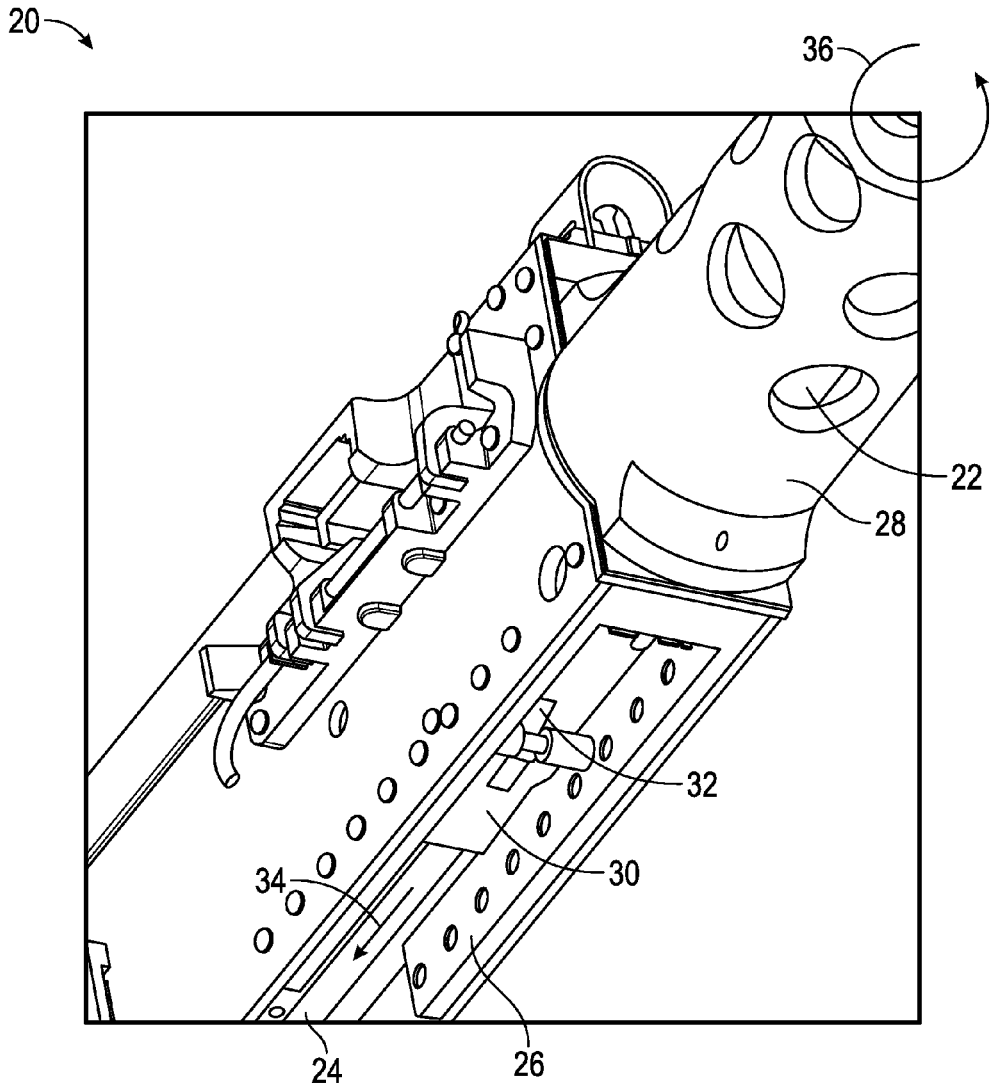
FIG. 2 is a fragmentary view illustrating a portion of the machine gun assembly of FIG. 1.
Figure 7:
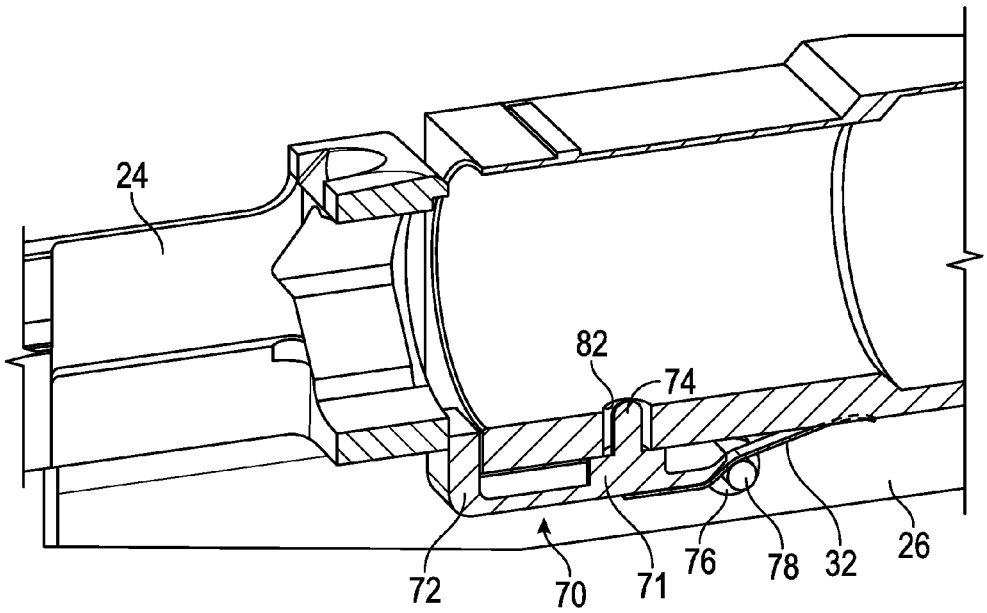
FIG. 7 is a perspective, cross-sectional view illustrating a portion of a barrel extension and a receiver of the machine gun assembly of FIG. 1.
Figure 10:
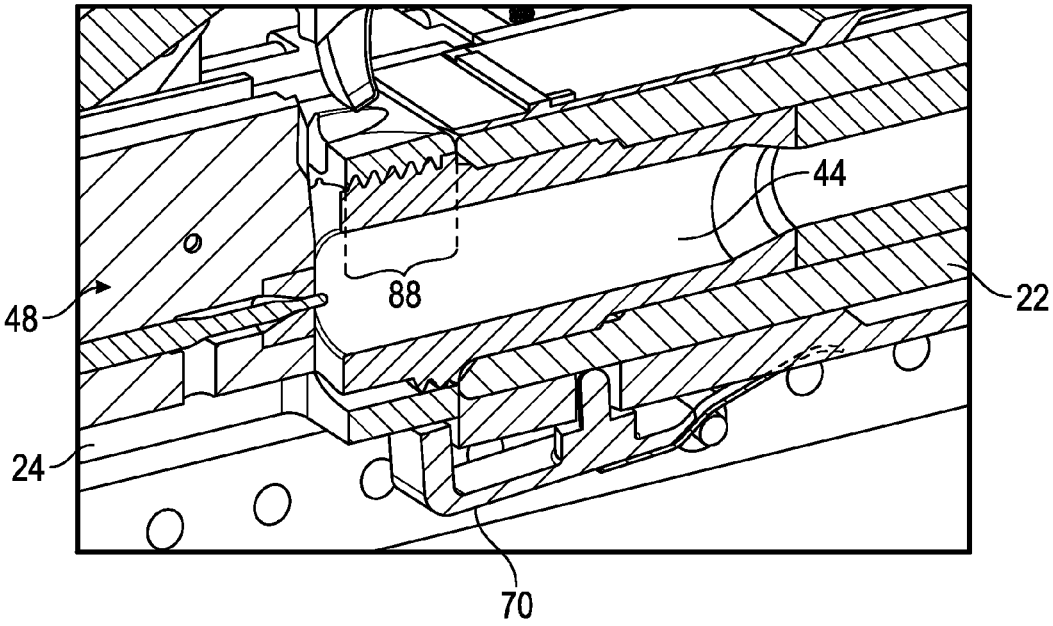
FIG. 10 is a perspective, cross-sectional view illustrating the interlock element after it has been moved out of obstruction with the barrel extension, and permitting the barrel extension to move to its forward position with respect to the receiver.

FIG. 2 is a fragmentary perspective view of machine gun assembly 20. Machine gun assembly 20 includes a barrel 22 engaged with a barrel extension 24 (as best seen in FIG. 10). Barrel extension 24 is supported by a receiver 26 and is configured to move with respect to receiver 26 between a forward position (as best seen in FIG. 10) and a rear position (as best seen in FIG. 7). Barrel extension 24 is biased towards its forward position and, in the absence of any obstruction, will automatically return to its forward position after being moved backward from its forward position. Receiver 26 includes a slot in its lower region that receives barrel extension 24 and that guides barrel extension 24 as it moves between its forward position and its rear position.

Barrel 22 is supported by a barrel support 28. Barrel support 28 is coupled with receiver 26 and comprises a tubular structure that envelops barrel 22 while barrel 22 is engaged with barrel extension 24. Among other things, barrel support 28 guides the movement of barrel 22 towards barrel extension 24 as a user attempts to re-engage barrel 22 with barrel extension 24 after barrel 22 has been disassembled from machine gun assembly 20.

An interlock element 30 is mounted to an underside of receiver 26. Interlock element 30 is configured to pivot between a blocking position (as best seen in FIG. 7) and a clear position (as best seen in FIG. 10). A spring 32 urges interlock element 30 towards the blocking position. In FIG. 2, barrel 22 is properly engaged with barrel extension 24 and, accordingly, interlock element 30 resides in the clear position. Barrel extension 24 is in its forward position which places a bolt sub-assembly (see FIGS. 4 and 10) adjacent to a chamber (see FIG. 3) of barrel 22. With these various components disposed in the position illustrated in FIG. 2, if there is a round in the chamber, machine gun assembly 20 may be discharged.

If an operator wanted to remove barrel 22 from machine gun assembly 20 for cleaning, maintenance, replacement, inspection, or any other purpose, the operator would first have to move barrel extension 24 backward from its forward position, in the direction indicated by arrow 34. Once barrel extension 24 has been moved backward from its forward position, the operator may then rotate barrel 22 in the direction indicated by arrow 36 to remove barrel 22 from machine gun assembly 20. Once these two actions have occurred, interlock element 30 will automatically move to the blocking position under the urging of spring 32 and will inhibit barrel extension 24 from returning to its forward position. This will be described in greater detail below.

Figure 3:
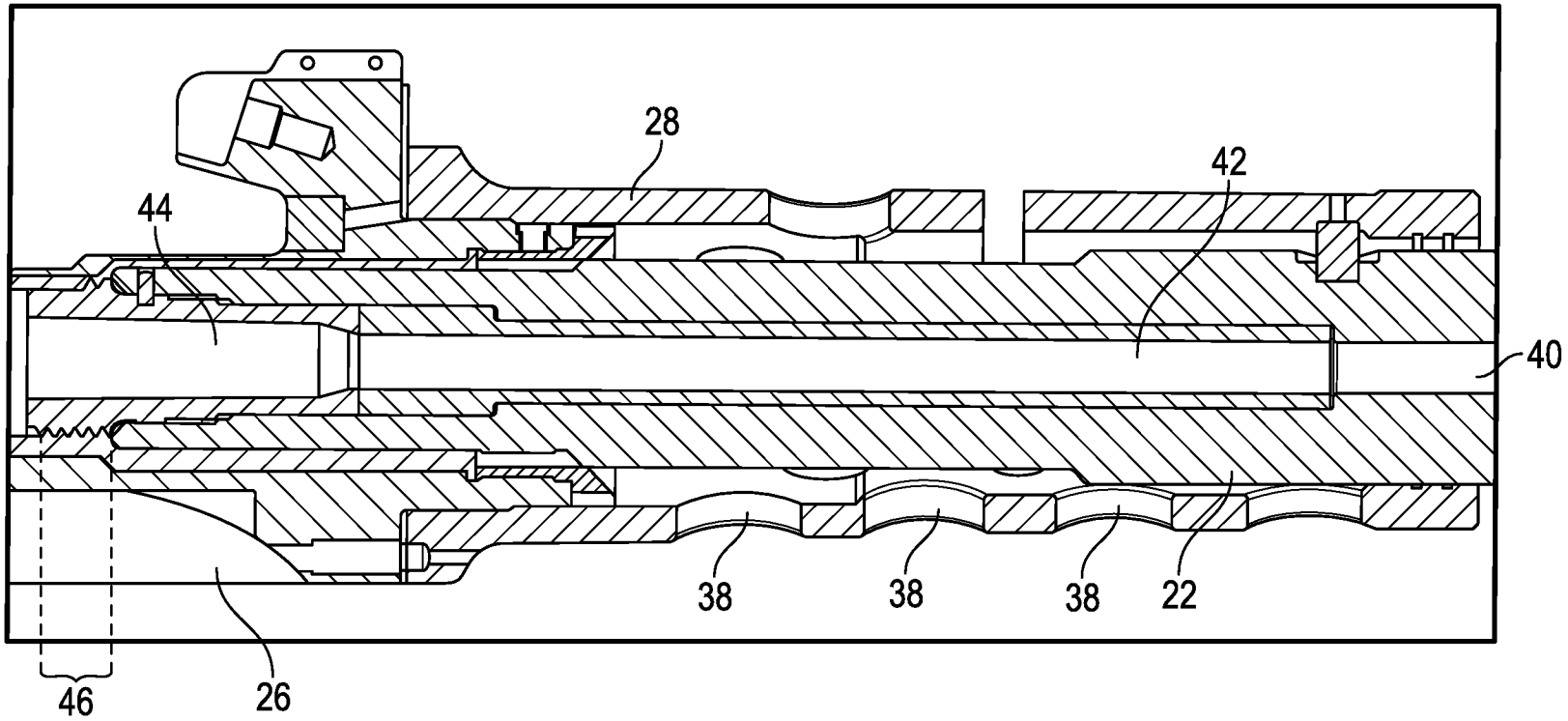
FIG. 3 is a cross-sectional view illustrating a barrel and barrel support of the machine gun assembly of FIG. 1.

FIG. 3 is a fragmentary cross-sectional view of a portion of barrel 22 and receiver 26. With continuing reference to FIG. 1-2, several components of machine gun assembly 20, such as barrel extension 24 and the bolt sub-assembly have been omitted for the purposes of simplifying the illustration. As illustrated, barrel support 28 surrounds barrel 22 and includes several ventilation openings 38 to ventilate and permit cooling of barrel 22 as machine gun assembly 20 is discharged. Barrel 22 includes a bore 40 and a liner 42, both of which guide a round after it has been expelled from a cartridge when machine gun assembly 20 is discharged. Barrel 22 further includes a chamber 44 that is configured to house a cartridge. An inner surface of chamber 44 has a contour that closely conforms to the contours of the cartridge.

An outer portion of barrel 22 includes quick release threads 46. Quick release threads 46 are configured to engage a set of quick release threads on barrel extension 24 (see FIG. 10). Quick release threads 46 extend only partially around a periphery of chamber 44. This allows quick release threads 46 to engage with, and to disengage from, the quick release threads of barrel extension 24 through a short rotation of barrel 22. For example, barrel 22 may need only a forty five degree or ninety degree twist to engage with, and disengage from barrel extension 24.

Also illustrated in FIG. 3 is a portion of receiver 26. Receiver 26 partially envelopes chamber 44. Receiver 26 also engages with barrel support 28. As illustrated in FIG. 2, receiver 26 also supports barrel extension 24. In this manner, receiver 26 is configured to serve as a support or base for substantially all of the components of machine gun assembly 20.

Figure 4:
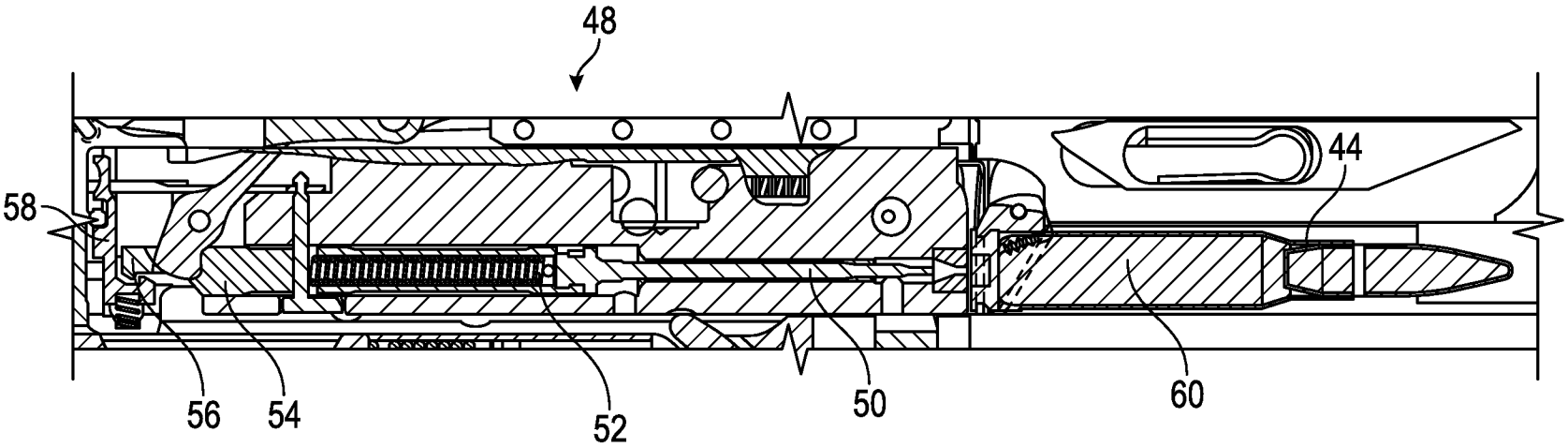
FIG. 4 is a cross-sectional view illustrating a portion of a bolt of the machine gun assembly of FIG. 1.

FIG. 4 is a cross-sectional view illustrating a bolt sub-assembly 48. With continuing reference to FIGS. 1-4, bolt sub-assembly 48 is adapted for mounting to barrel extension 24 and is configured to slide back and forth with respect to barrel extension 24 as machine gun assembly 20 is fired and as cartridges are alternately loaded and ejected from chamber 44. Bolt sub-assembly 48 includes a firing pin 50. Firing pin 50 is biased towards a firing position (towards the right side of FIG. 4) by a spring 52. However, in FIG. 4, firing pin 50 is illustrated in a retracted position. A firing pin extension 54 is coupled to firing pin 50 and moves with firing pin 50 between the retracted position and the firing position. When firing pin 50 is in the firing position and an operator pulls on a lever (not shown) that is attached to firing pin extension 54, firing pin extension 54 will move out of the firing position and towards the retracted position. A back end 56 of firing pin extension 54 is configured to engage a sear 58. When the lever is pulled far enough to allow back end 56 to engage sear 58, back end 56 and a lower portion of sear 58 will enter into a latched engagement wherein firing pin extension 54 and firing pin 50 remain in the retracted position.

When a downward force is applied to sear 58, sear 58 and back end 56 of firing pin extension 54 come out of latched engagement and firing pin 50 is free to move towards its firing position under the force of spring 52. When firing pin 50 reaches the firing position, the tip of firing pin 50 will protrude beyond the end of bolt sub-assembly 48.

In FIG. 4, a cartridge 60 disposed in chamber 44. When barrel 22 (see FIG. 3) is correctly engaged with barrel extension 24, a primer end of cartridge 60 is positioned directly in the path that firing pin 50 takes to reach the firing position. When firing pin 50 reaches the firing position, firing pin 50 will strike the primer of cartridge 60. The primer will ignite the propellant inside of cartridge 60 which then combusts and generates the pressure that pushes a projectile through, and then out of, barrel 22 and on down range.

Figure 5:
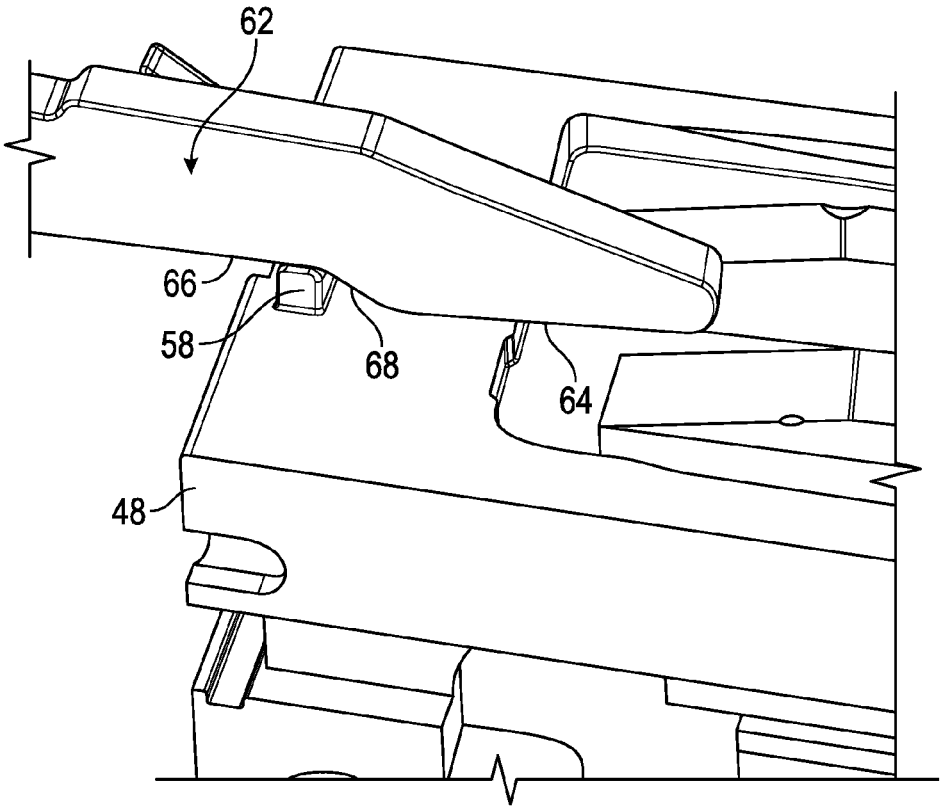
FIG. 5 is a perspective view illustrating a trigger bar and a portion of the bolt of FIG. 4.

FIG. 5 is a perspective view illustrating a portion of a trigger bar 62 and a portion of bolt sub-assembly 48. With continuing reference to FIGS. 1-4, trigger bar 62 is attached to receiver 26 and is configured to remain stationary with respect to receiver 26 as bolt sub-assembly 48 and barrel extension 24 move forward and aft during firing. Consequently, as bolt sub-assembly 48 moves fore and aft, the upper surface of bolt sub-assembly 48 slides past an underside of trigger bar 62. An upper portion of sear 58 protrudes above an upper surface of bolt sub-assembly 48 and is positioned for engagement with trigger bar 62. Accordingly, as bolt sub-assembly 48 moves fore and aft with respect to trigger bar 62, sear 58 also moves fore and aft with respect to trigger bar 62.

As illustrated in FIG. 5, a lower surface of trigger bar 62 has a contour that causes a forward portion 64 to be positioned closer to an upper surface of bolt sub-assembly 48 than an aft portion 66 of trigger bar 62. Accordingly, as bolt sub-assembly 48 slides fore and aft with respect to trigger bar 62, forward portion 64 and aft portion 66 are alternately positioned above sear 58. When aft portion 66 is disposed above sear 58, trigger bar 62 is prohibited from engaging sear 58 because the downward travel of the trigger bar 62 is limited. When forward portion 64 is positioned above sear 58, downward movement of trigger bar 62 is not obstructed and the contoured trigger bar surface 64 can depress sear 58 in a downward direction. Such engagement will cause the release of the firing pin, thereby allowing machine gun assembly 20 to discharge.

In the illustrated embodiment, the lower surface of trigger bar 62 also includes a ramped portion 68 where the lower surface transitions from aft portion 66 to forward portion 64. This ramped portion is also capable of depressing sear 58. Accordingly, whenever sear 58 is positioned under either forward portion 64 or ramped portion 68, trigger bar 62 is disposed within a firing window and whenever sear 58 is disposed under aft portion 66, trigger bar 62 is disposed outside of the firing window. From this discussion, it can be understood that if the movement of barrel extension 24 towards its forward position is obstructed, then movement of bolt sub-assembly 48 is also obstructed and furthermore, if such movement of bolt sub-assembly 48 is obstructed while trigger bar 62 is disposed outside of the firing window, then machine gun assembly 20 is inhibited from being discharged.

Figure 6:
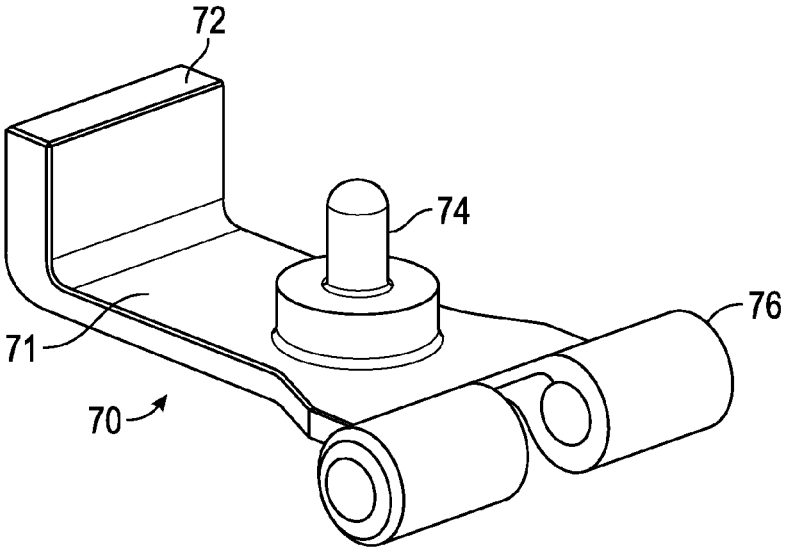
FIG. 6 is a perspective view illustrating an interlock element made in accordance with the teachings of the present disclosure.

FIG. 6 is a perspective view illustrating a non-limiting embodiment of an interlock element 70. With continuing reference to FIGS. 1-5, interlock element 70 is configured for use with machine gun assembly 20 to inhibit machine gun assembly 20 from being discharged at times when barrel 22 is not correctly engaged with barrel extension 24. Interlock element 70 includes central portion 71, a blocking portion 72 projecting in a perpendicular manner from central portion 71, a barrel engaging portion 74 also projecting in a perpendicular direction from central portion 71, and a pivot mount 76 disposed at an end of central portion 71.

FIG. 7 is a perspective view illustrating interlock element 70 mounted to an underside of receiver 26 in a position that disposes blocking portion 72 proximate to the forward position of barrel extension 24. Interlock element 70 is pivotally mounted to receiver 26 via a pin 78 that is inserted through pivot mount 76. Mounted in this manner, interlock element 70 is able to pivot between a blocking position, illustrated in FIG. 7, and a clear position as illustrated in FIG. 10. A spring 32 is engaged with central portion 71 and biases interlock element 70 towards the blocking position. When interlock element 70 is in the blocking position, as illustrated in FIG. 7, blocking portion 72 is positioned to obstruct movement of barrel extension 24 to its forward position. As discussed above, when barrel extension 24 is held back from its forward position, bolt sub-assembly 48 is correspondingly held back such that trigger bar 62 resides outside of the firing window.

As illustrated in FIG. 7, receiver 26 includes an opening 82. Opening 82 extends entirely through an outer wall of receiver 26. Barrel engaging portion 74 is configured to extend through opening 82. In this manner, barrel engaging portion 74 is able to engage with barrel 22 (not shown in FIG. 7), as explained in greater detail below.

Figure 8:
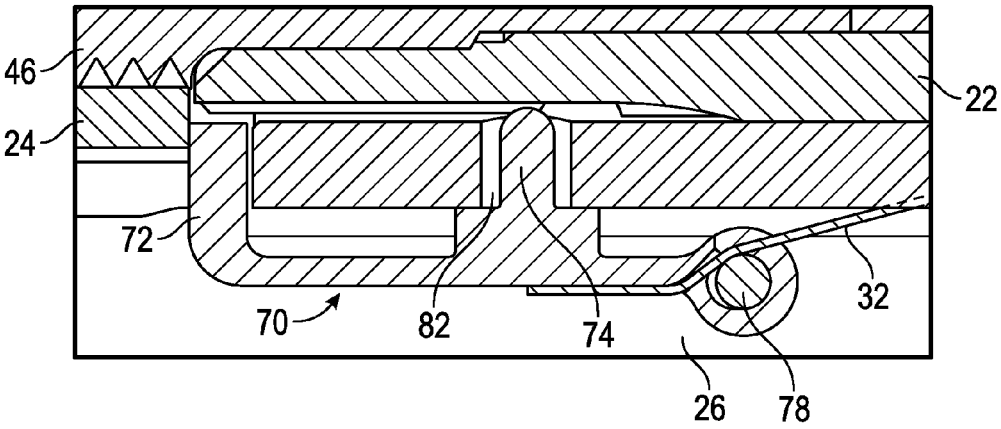
FIG. 8 is an expanded cross-sectional view illustrating the interlock element obstructing forward movement of the barrel extension with respect to the receiver.

FIG. 8 is an expanded cross-sectional view illustrating in greater detail some of the details that were illustrated in FIG. 6. In FIG. 8, barrel 22 is disposed within receiver 26 and is positioned in an engagement position with respect to barrel extension 24, but prior to engagement therewith. In this view it can be clearly seen that blocking portion 72 interferes with barrel extension 24 so as to maintain barrel extension 24 in a stand-off position that is retracted from its forward position. Also visible in FIG. 8 is the way in which barrel engaging portion 74 extends through opening 82. As illustrated, an upper end of barrel engaging portion 74 protrudes above an inner surface of receiver 26. This protrusion enables engagement between barrel engaging portion 74 and barrel 22.

Figure 9:
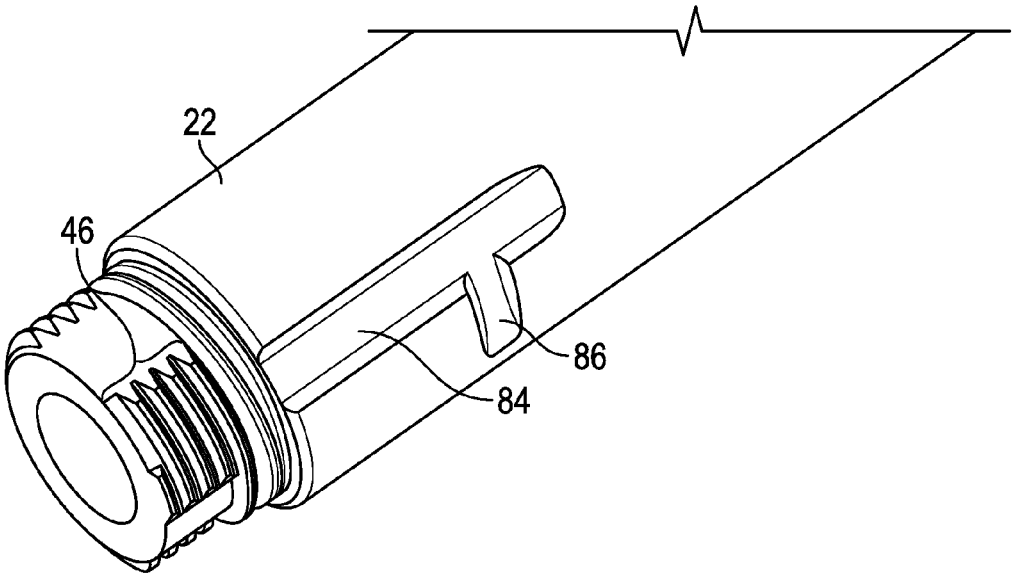
FIG. 9 is a perspective view illustrating a portion of the barrel configured for usage in accordance with the teachings of the present disclosure.

FIG. 9 is a perspective view illustrating a portion of barrel 22. In this view, quick release threads 46 can be observed in greater detail. As discussed above, quick release threads 46 extend only partially around barrel 22 in the circumferential direction to allow for quick engagement and quick disengagement from barrel extension 24.

With continuing reference to FIG. 8, when barrel 22 is disposed in the engagement position (illustrated in FIG. 8), but has not yet been rotated into engagement with barrel extension 24, a slot 84 defined in a surface of barrel 22 comes into alignment with the upper portion of barrel engaging portion 74 and provides clearance. As a result, barrel engaging portion 74 does not engage barrel 22.

As illustrated in FIG. 9, slot 84 has a ramped portion 86 that is ramped in the circumferential direction of barrel 22. Accordingly, as barrel 22 is rotated into engagement with barrel extension 24, the clearance between barrel 22 and barrel engaging portion 74 dissipates and the slot acts as a camming surface that presses up against the upper portion of barrel engaging portion 74. This, in turn, causes interlock element 70 to pivot about pin 78 towards the clear position.

As interlock element 70 pivots to the clear position, blocking portion 72 retracts from its engagement with barrel extension 24. Once interlock element 70 has reached the clear position, blocking portion 72 comes completely out of engagement with barrel extension 24 and barrel extension 24 is left free to move towards its forward position under the urging of a spring or other biasing means (not shown).

FIG. 10 is a perspective view illustrating barrel 22 fully engaged with barrel extension 24. With continuing reference to FIGS. 1-9, quick release threads 46 have been rotated into engagement with quick release threads 88 of barrel extension 24 and, as a result, barrel 22 is locked into barrel extension 24. While locked together, barrel 22 and barrel extension 24 will reciprocate together with respect to receiver 26 as machine gun assembly 20 is discharged.

With barrel 22 rotated into engagement with barrel extension 24, ramped portion 86 cams barrel engaging portion downward, causing interlock element 70 to pivot to the clear position. Barrel extension 24 has moved into its forward position and has brought bolt sub-assembly 48 with it. As bolt sub-assembly 48 moves forward, it comes into close proximity with chamber 44, and thereby is positioned to permit firing pin 50 to initiate a firing cycle of a cartridge when a cartridge is disposed within chamber 44.

Figure 11:
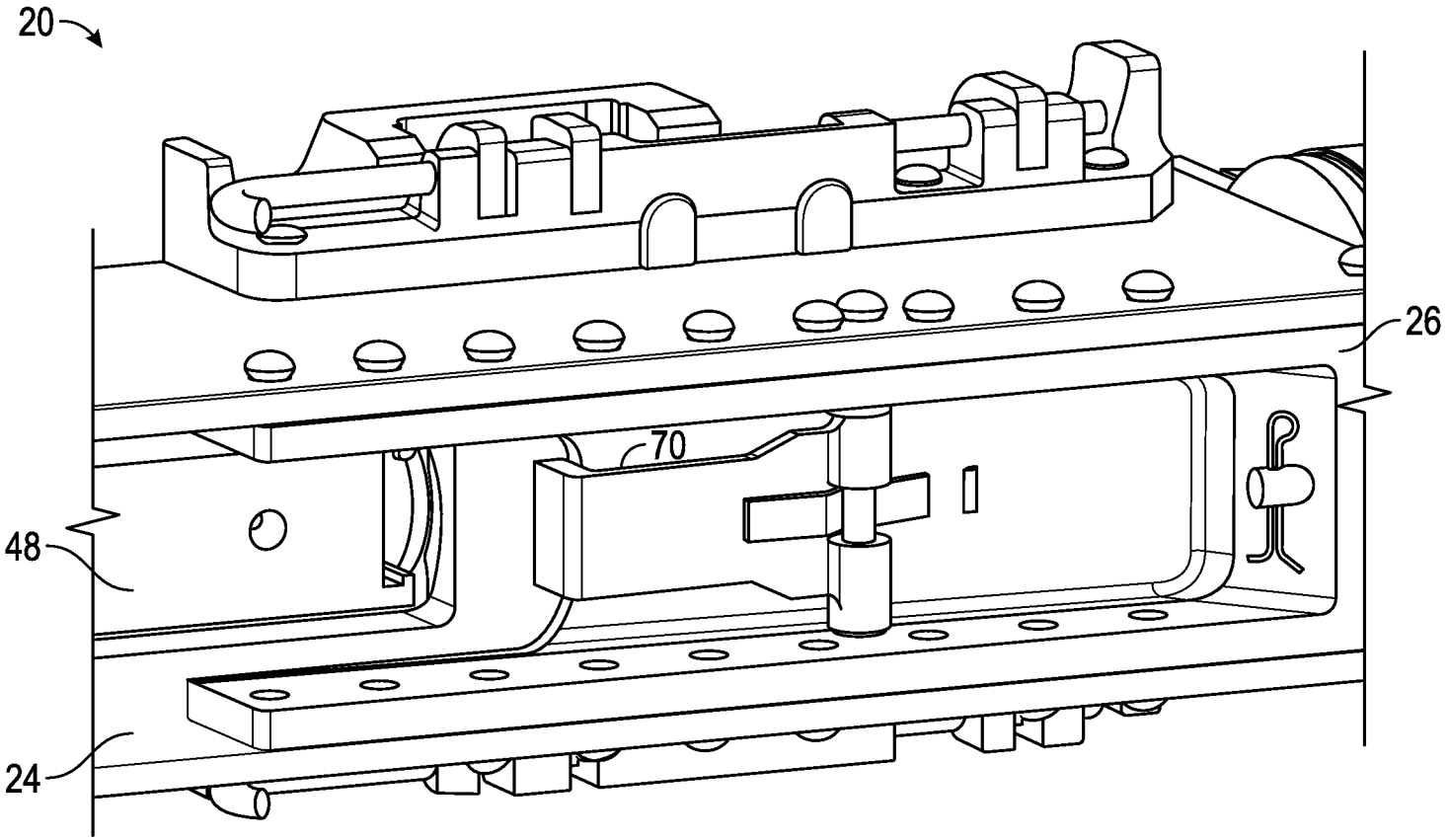
FIG. 11 is a perspective view illustrating an underside of a portion of the machine gun assembly in accordance with the teachings of the present disclosure.

FIG. 11 illustrates an underside of machine gun assembly 20. In this figure, the nested relationship between receiver 26 and barrel extension 24 can be observed as well as the relationship between bolt sub-assembly 48 and barrel extension 24. Also illustrated in this view is interlock element 70 mounted to an underside of receiver 26. It should be understood that in other embodiments, interlock element 70 may be mounted elsewhere on machine gun assembly 20 without departing from the teachings of the present disclosure.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A machine gun assembly comprising:

a receiver;

a barrel extension mounted to the receiver and configured to move between a forward position and a retracted position with respect to the receiver, the barrel extension being biased towards the forward position and configured for quick-release engagement with a barrel; and an interlock element mounted to the receiver and configured to move between a blocking position and a clear position, the interlock element being biased towards the blocking position, the interlock element having a blocking portion positioned to obstruct movement of the barrel extension to the forward position when the interlock element is in the blocking position and the blocking portion positioned to permit movement of the barrel extension to the forward position when the interlock element is in the clear position, the interlock element configured to move to the blocking position when the barrel disengages from the barrel extension and the interlock element configured to move to the clear position when the barrel engages the barrel extension, the interlock element further including a barrel engaging portion configured to engage the barrel when the barrel is engaged with the barrel extension.

2. The machine gun assembly of claim 1, wherein the interlock element is configured to pivot between the blocking position and the clear position.

3. The machine gun assembly of claim 1, further comprising a biasing member associated with the interlock element and configured to urge the interlock element towards the blocking position.

4. The machine gun assembly of claim 1, wherein the barrel engaging portion extends through an opening in the receiver to engage the barrel.

5. The machine gun assembly of claim 1, wherein the barrel engaging portion comprises a pin or boss or protruding feature.

6. The machine gun assembly of claim 1, wherein the interlock element is configured to pivot between the blocking position and the clear position, wherein the barrel engaging portion is disposed between the blocking portion and a pivot point of the interlock element, and wherein the barrel engaging portion causes the interlock element to pivot to the clear position when the barrel engages the barrel extension.

7. A machine gun assembly comprising:

a receiver;

a barrel extension mounted to the receiver and configured to move between a forward position and a retracted position with respect to the receiver, the barrel extension being biased towards the forward position and having a set of female quick release threads;

a bolt sub-assembly mounted to the barrel extension and configured to move together with the barrel extension, the bolt sub-assembly including a firing pin configured to engage a cartridge and a sear configured to control the firing pin;

a barrel configured to be selectively engaged with, and disengaged from, the barrel extension, the barrel having a chamber, a bore, and a male set of quick release threads engaged with the female set of quick release threads when the barrel is engaged with the barrel extension;

a trigger bar disposed proximate the bolt sub-assembly and configured to remain stationary with respect to the receiver, the trigger bar being disposed in a firing window with respect to the sear when the barrel extension is in the forward position, and wherein the trigger bar is disposed outside of the firing window when the barrel extension is out of the forward position; and an interlock element mounted to the receiver and configured to move between a blocking position and a clear position, the interlock element being biased towards the blocking position, the interlock element having a blocking portion positioned to obstruct movement of the barrel extension to the forward position when the interlock element is in the blocking position and the blocking portion positioned to permit movement of the barrel extension to the forward position when the interlock element is in the clear position, the interlock element configured to move to the blocking position when the barrel disengages from the barrel extension, the interlock element configured to move to the clear position when the barrel engages the barrel extension.

8. The machine gun assembly of claim 7, wherein the female set of quick release threads and the male set of quick release threads have a minimal lead.

9. The machine gun assembly of claim 7, wherein the interlock element is configured to pivot between the blocking position and the clear position.

10. The machine gun assembly of claim 7, further comprising a biasing member associated with the interlock element and configured to urge the interlock element towards the blocking position.

11. The machine gun assembly of claim 7, wherein the interlock element further includes a barrel engaging portion configured to engage the barrel when the barrel is engaged with the barrel extension.

12. The machine gun assembly of claim 11, wherein the barrel engaging portion extends through an opening in the receiver to engage the barrel.

13. The machine gun assembly of claim 11, wherein the barrel engaging portion comprises a pin or a boss or protruding feature.

14. The machine gun assembly of claim 11, wherein the interlock element is configured to pivot between the blocking position and the clear position, wherein the barrel engaging portion is disposed between the blocking portion and a pivot point of the interlock element, and wherein the barrel engaging portion causes the interlock element to pivot to the clear position when the barrel engages the barrel extension.

15. The machine gun assembly of claim 11, wherein the barrel includes a slot to engage the barrel engaging portion.

16. The machine gun assembly of claim 15, wherein the slot is ramped.

17. The machine gun assembly of claim 16, wherein at a first end of the slot, the slot has a depth configured to receive the barrel engaging portion, and wherein at a second end of the slot, the slot is substantially flush with a surface of the barrel.

18. An interlock element for use with a machine gun having a receiver and a barrel extension configured to move with respect to the receiver between a forward position and a rear position, the barrel extension being biased towards the forward position and configured for quick-release engagement with a barrel, the interlock element comprising:

a supporting portion configured for attachment to the receiver, the supporting portion configured to move between a blocking position and a clear position;

a blocking portion associated with the supporting portion and configured to obstruct movement of the barrel extension to the forward position when the interlock element is in the blocking position while the supporting portion is attached to the receiver and the blocking portion configured to permit movement of the barrel extension to the forward position when the interlock element is in the clear position while the supporting portion is attached to the receiver; and a barrel engaging portion configured to engage the barrel when the barrel is engaged with the barrel extension.

19. The interlock element of claim 18, wherein the supporting portion is configured to move to the blocking position when the barrel disengages from the barrel extension and the supporting portion is configured to move to the clear position when the barrel engages the barrel extension.

* * * * *